United States Patent [19]

Jordan

[11] 4,337,739

[45] Jul. 6, 1982

[54] VALVE CONTROL MECHANISM FOR INTERNAL COMBUSTION ENGINES

[76] Inventor: Edgar R. Jordan, 32260 W. Twelve Mile Rd., Farmington, Mich. 48018

[21] Appl. No.: 132,949

[22] Filed: Mar. 24, 1980

[51] Int. Cl.[3] ..... F02D 13/06

[52] U.S. Cl. ..... 123/198 F; 123/90.16; 123/90.55

[58] Field of Search ..... 123/90.12, 90.45, 90.46, 123/90.48, 90.53, 90.55, 90.56, 90.57, 90.58, 198 F

[56] References Cited

U.S. PATENT DOCUMENTS

| | | | |
|---|---|---|---|
| 2,309,740 | 2/1943 | Voorhies | 123/90.56 |
| 2,346,737 | 4/1944 | Essel | 123/90.56 |
| 2,376,182 | 5/1945 | Peterson, Jr. | 123/90.56 |
| 2,948,274 | 8/1960 | Wood | 123/198 F |
| 4,133,332 | 1/1979 | Benson et al. | 123/198 F |

*Primary Examiner*—Craig R. Feinberg
*Assistant Examiner*—W. R. Wolfe
*Attorney, Agent, or Firm*—Reising, Ethington, Barnard, Perry & Brooks

[57] ABSTRACT

An internal combustion engine valve deactivator mechanism including a pair of reciprocable cylindrical members and a movable piston therein which together function as a normal tappet when pressurized fluid is fed to a chamber defined between the piston and a first cylindrical member but when the pressurized fluid is exhausted from the chamber the engine valves of the engine remain seated by their respective valve springs while the two cylindrical members are allowed to reciprocate with respect to each other by the piston. Engine oil pressure may be used as the operating fluid for the valve deactivator. An inlet passage formed in the cylinder block feeds pressurized fluid to the chamber in a first position of a control valve located within the cylinder block to move the piston away from the first member to prevent the second member from reciprocating with respect to the first member and thereby enable normal operation of an engine cylinder intake or exhaust valve by its pushrod. An exhaust passage also formed in the cylinder block exhausts the pressurized fluid from the chamber in a second position of the control valve so that the piston is movable towards the first member to allow the second member to reciprocate with respect to the first member to thereby deactivate the valve operation.

1 Claim, 4 Drawing Figures

VALVE CONTROL MECHANISM FOR INTERNAL COMBUSTION ENGINES

TECHNICAL FIELD

This invention relates to an internal combustion engine control mechanism for affecting split engine operation and to valve deactivators used with the intake and exhaust valves of the engine to control its operation.

BACKGROUND ART

Internal combustion engines that operate in a split engine mode to achieve fuel economy have been previously developed but have yet to achieve wide commercial usage. Selected cylinders of the engine are deactivated during split engine operation so that no fuel is fed to them but rather is fed only to the other cylinders. Intake and exhaust valve deactivators are utilized to provide this control of the cylinder operation. A V-8 cylinder engine will normally have one or two of its cylinders on each bank rendered inoperative by valve deactivators during the split engine operation to provide four or six cylinder operation and will have all eight of its cylinders functioning during full engine operation. Likewise a V-6 cylinder engine will have one or two cylinders on one or both sides operating during split engine operation for two, three or four cylinder operation and all six cylinders will function during full engine operation.

Prior patents disclose engine valve deactivators having various constructions and which are positioned at various locations between the camshaft of the engine and the controlled valve of the engine. For example, U.S. Patent of Winkler, Jr. U.S. Pat. No. 2,745,391 discloses the use of a valve tappet construction and cooperating control mechanism for some of the engines cylinders which will render the valves for the cylinders and, consequently, the cylinders inoperable except during starting, acceleration and high power output. The particular construction disclosed therein includes a hollow reciprocable cylinder, a piston in the cylinder forming an enclosed chamber therein, a fluid inlet passage for a chamber, a fluid outlet passage for the chamber in the piston, a control valve in the outlet passage, a spring urging the valve toward the closed position and a lever for opening the valve.

The U.S. Patent of Fuller, Jr. et al U.S. Pat. No. 4,050,435 discloses a cut-out device selectively operable to function as a rigid extension of a valve pushrod or as a deactivating means between the pushrod and its respective valve. An inner hollow piston is slidable within an outer cylinder and between a pair of axially aligned fluid isolated chambers. The piston is disposed in one of the chambers and a pushrod end is slidably received in the opposite chamber. Fluid pressure lines are connected to fluid ports in the outer cylinder such that the fluid ports are in communication with the chambers of the hollow piston.

The U.S. Patent of Jordan U.S. Pat. No. 4,175,534 discloses a valve deactivator which includes a rotatable first cylindrical member axially fixed on an elongated engine support and also includes a second cylindrical member defining an enclosed cavity with the first member while positioned on the support between the engine and the first member. A helical spring of the deactivator circles the cylindrical members thereof and has a first end axially fixed relative to the support and the second end that biases a rocker arm bearing toward the engine.

Ports in the support and the first cylindrical member define inlet and exhaust passages to the cavity with the first cylindrical member in first and second rotational positions so as to allow the supply and exhaustion of pumped engine oil in the cavity in order to position the second cylindrical member axially along the support so as to control valve operation.

Other valve deactivators of the type to which this invention relates are disclosed by the U.S. Patent of Brown, U.S. Pat. No. 3,964,455, Cartledge U.S. Pat. No. 3,809,033, Benson et al U.S. Pat. No. 4,133,332 and Jordan U.S. Pat. No. 4,114,588.

DISCLOSURE OF THE INVENTION

An object of the present invention is to provide an improved valve deactivator for an internal combustion engine intake or exhaust valve so as to control the valve operation while having a compactly packaged construction without requiring any extensive molding or machining of the engine with which the valve deactivator is used. Another object of this invention is to provide an improved valve deactivator for an internal combustion engine intake or exhaust valve so as to control valve operation and which may be readily installed in or removed from standard automobile engines.

A further object of the invention is to provide an improved valve deactivator for an internal combustion engine intake or exhaust valve so as to control valve operation and which includes a tappet which is hydraulically operated to collapse when the hydraulic fluid pressure therein drops below a predetermined level during engine operation.

In carrying out the above objects and other objects of this invention a preferred embodiment of the invention includes first and second cylindrical members reciprocal in an axial relationship with respect to each other to define a cavity therebetween of a volume that varies upon relative axial movement between the members. A piston is located within the cavity and is sealingly slidable in axial relationship with the first cylindrical member to define a chamber therebetween that varies upon relative axial sliding between the first cylindrical member and the piston. Means are provided for alternately feeding pressurized fluid to and exhausting pressurized fluid from a chamber so that when the chamber is pressurized the piston moves away from the first cylindrical member to prevent the second cylindrical member from reciprocating with respect to the first cylindrical member and so that when the chamber is exhausted, the piston is movable towards the first cylindrical member to allow the second cylindrical member to reciprocate with respect to the first cylindrical member to deactivate the valve operation. Biasing means are provided which are operatively associated with the first and second cylindrical members for biasing the first and second cylindrical members apart during the reciprocation when the chamber is exhausted.

Preferably, engine oil under pressure is used as the operating fluid for the valve control mechanism and any suitable control system can be used to selectively regulate its operation. Fluid supplied to a single internal chamber enables a part of the mechanism to function as a normal tappet and when the fluid is exhausted from the chamber the tappet collapses and the pushrod of the engine does not move in response to camshaft rotation whereby the intake or exhaust valves will remain seated by their respective valve springs. In any mode of operation, however, the camshaft action is not interrupted or mechanically interfered with.

The objects, features and advantages of the present invention are readily apparent from the following detailed description of the best mode taken in connection with the accompanying drawings.

BEST MODE FOR CARRYING OUT THE INVENTION

Figure 1:
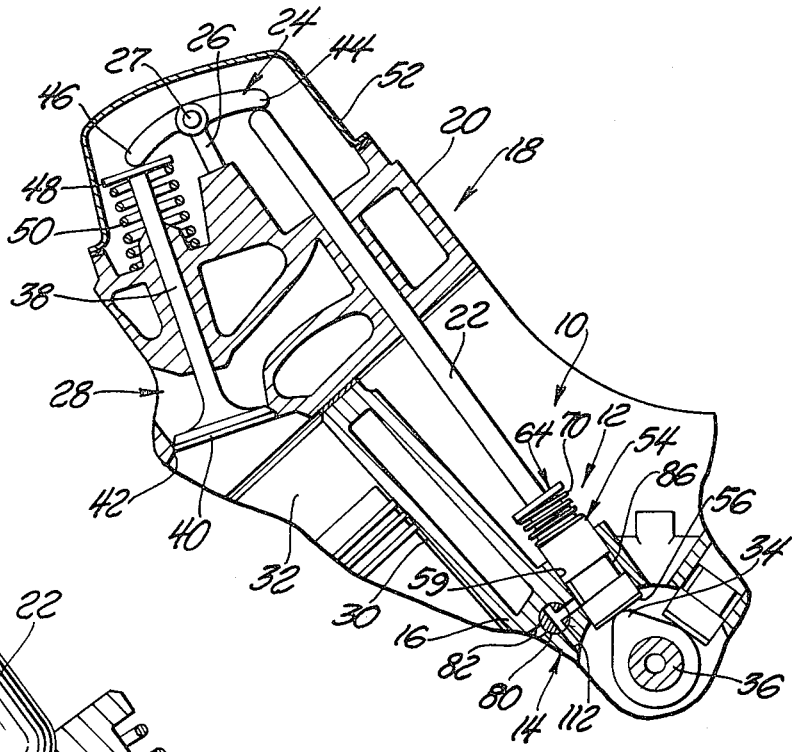
FIG. 1 is a sectional view of a typical installation of a preferred embodiment of the invention in an internal combustion engine.

Referring to FIG. 1 an intake or exhaust valve control mechanism constructed according to the present invention is indicated collectively by reference numeral 10 and includes a collapsible hydraulic tappet 12 and means 14 disposed within the cylinder block 16 of an internal combustion engine 18 for controllably supplying and exhausting the hydraulic control fluid of the tappet 12.

The engine 18 comprises a valve in-head internal combustion engine of typical configuration and will be described with reference to a single control mechanism 10 for the sake of simplicity.

The engine includes a cylinder head 20 through which extends a solid pushrod 22 disposed between the tappet 12 and a rocker arm 24. The rocker arm 24 is pivotably mounted on a support 26 at a pivot 28. The support 26 is fixedly mounted in and extends upwardly from the cylinder head 20 in a conventional fashion. An exhaust valve 28 associated with one of the cylinders 30 is controlled during reciprocal movement of a piston 32 within the cylinder 30. Reciprocal movement of the pushrod 22 when the control mechanism 10 is in its valve activated condition, is caused by a cam 34 carried on a camshaft 36 which in turn, causes the rocker arm 24 to pivot so as to reciprocate a valve stem 38 of the valve, lower end of which carries a valve head 40 that opens and closes the valve opening 42 to the cylinder 30. The pivot 27 supports an intermediate portion of the rocker arm 24 with its pushrod and valve actuating ends 44 and 46, respectively, maintained in engagement with the upper end of the pushrod 22 and a fitting 48 formed at the top of the valve stem 38. A helical spring 50 has one end seated against the cylinder head 20 and the other end seated against the fitting 48 on the valve stem 38. A rocker arm cover 52 is secured to the cylinder head 20 by bolts (not shown) to enclose the exhaust valve 28 and the other valves on the same side of the engine 18.

Figure 2:
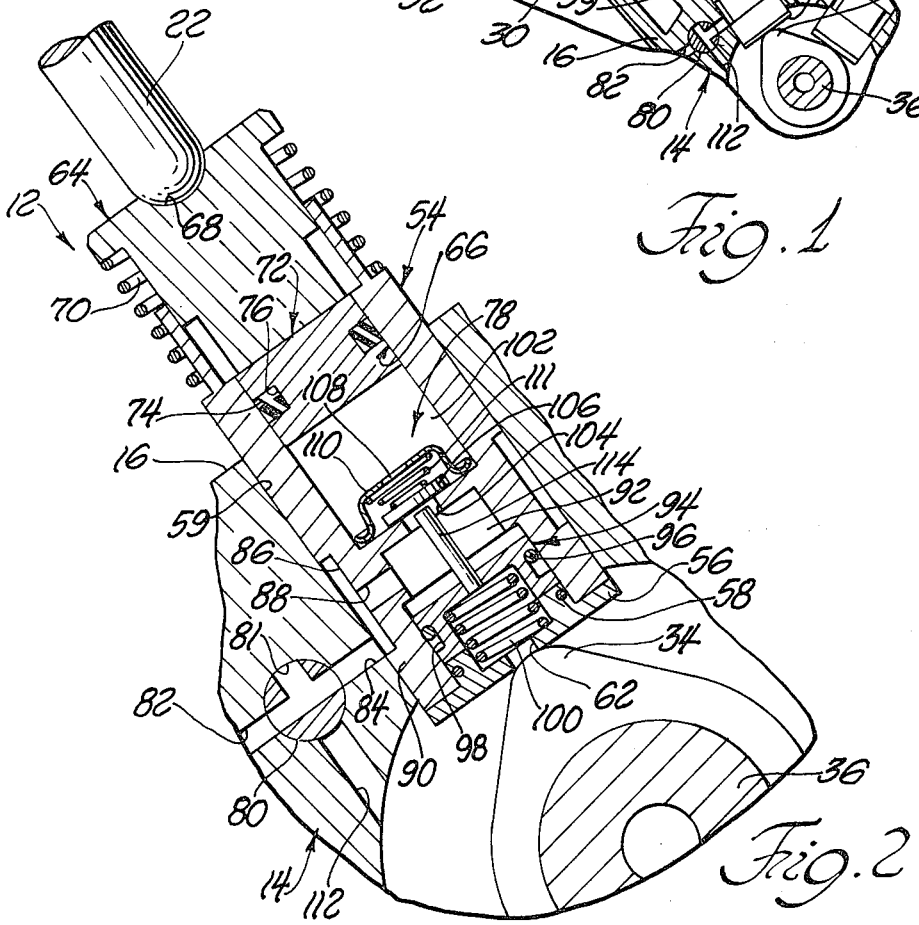
FIG. 2 is a sectional, side-elevational view of the valve control mechanism embodying the present invention with the control mechanism in its valve activated condition.

With reference to FIG. 2, the collapsible tappet 12 and the fluid control means 14 are shown in greater detail in a valve activated condition of the control mechanism 10. The tappet 12 includes first cylindrical member 54 open at one of its ends and closed at its opposite end by an end plate 56 which is secured thereto by a snap ring 58. The end plate 56 of the first member 54 has a vent hole 62 extending completely therethrough and over which the cam 34 slidably engages the end plate 56 to slidably reciprocate the tappet 12 within an aperature 59 formed completely through the cylinder block 16.

The tappet 12 also includes a second cylindrical member 64 which is slidably disposed in the open end of the first member 54 and is reciprocable with respect to the first member 54 in axial relationship to define a cavity 66 therebetween the volume of which varies upon relative axial movement between the first and second members 54 and 64, respectively. The second member 64 is adapted to receive and retain one end of the pushrod 22 within a dished out portion 68 of the second member 64 in order to transmit the reciprocating motion of the tappet 12 to the pushrod 22 as shown in FIG. 2 when the tappet 12 is in a rigid condition as will be described in greater detail herein below.

A helical biasing spring 70 is fixedly connected at its opposite ends to the first and second members 54 and 64, respectively, for biasing the first and second members 54 and 64 apart when they reciprocate with respect to each other as will be described in greater detail herein below when the tappet 12 is in a collapsed condition.

A piston 72 is located within the cavity 66 and is sealingly slidable in axial relationship with the first member 54 by means of a seal 74 disposed within an annular groove 76 formed on the outer circumferential surface of the piston 72. The piston 72 and the first member 54 define a chamber 78 therebetween that varies upon relative axial sliding movement between the first member 54 and the piston 72.

A cylindrical control valve 80 of the fluid control means 14 is rotatably and sealingly located within a bore 81 formed in the cylinder block 16. The control valve 80 allows fluid pressure, preferably engine oil pressure, to flow through an inlet passage 82 formed in the cylinder block 16 in a first position of the control valve 80. Fluid pressure is conducted by the control valve 20 through a connecting passage 84, through an annular recess 86 formed in the outer circumferential surface of the first member 54, through a radial passage 88 formed through a side wall 90 of the first member 54 and into the lower chamber half 92 of the chamber 78. The oil pressure in the lower chamber half 92 forces a third cylindrical member or slide 94 axially away from the second member 74 and against the end plate 56. The slide 94 is sealingly slidable in axial relationship with the first member 54 within the lower chamber half 92. A seal 96 is disposed within an annular groove 92 formed in the outer circumferential surface of the slide 94 to seal the slide 94 with respect to the first member 54. The slide 94 is biased away from the end plate 56 by a helical spring 100 which extends therebetween.

Oil enters the upper chamber half 102 of the chamber 78 through a control port 104 which communicates the upper and lower chamber halves 102 and 92, respectively. The oil goes through the control port 104, past a check valve 106 and through a hole 108 in a spring cup 110 mounted in the upper chamber half 102. A helical spring 111 extends between the spring cup 110 and the check valve 106 to seat the check valve 106 against the control port 104.

The oil pressure in the upper chamber half 102 moves the piston 72 axially away from the first member 54 to a position where it is restrained from further movement by the second member 64 through the pushrod connection to the rocker arm 44 against the valve 28. In this "filled" condition all lash between the valve 28 and the camshaft 36 is filled and the valve 28 will open and close in response to the camming action of the cam 34.

Figure 3:
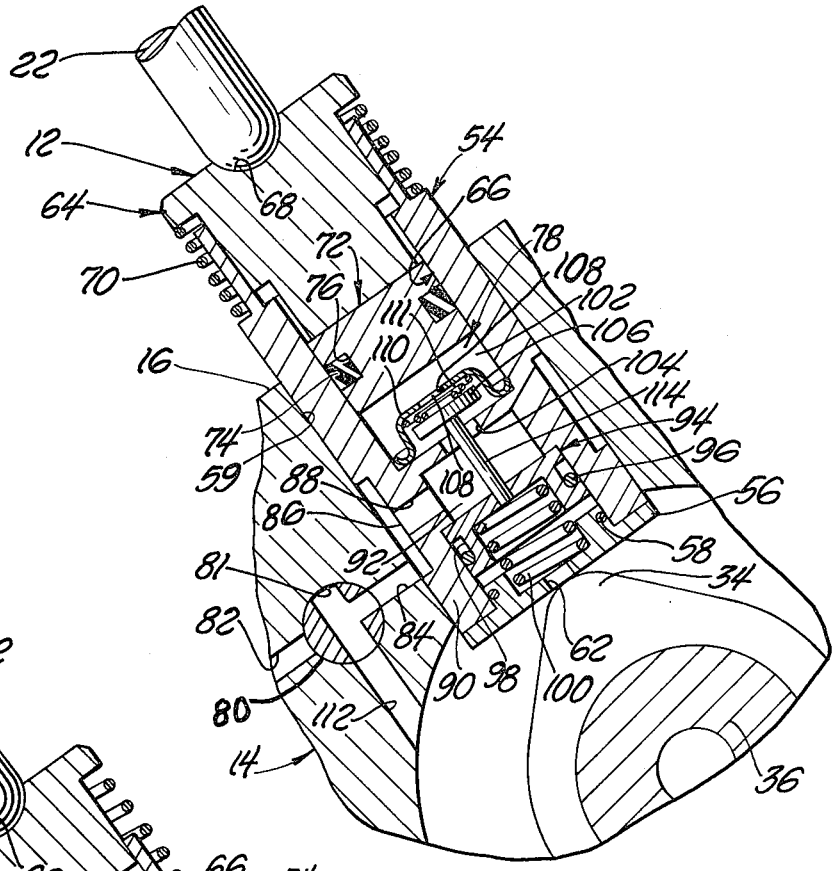
FIG. 3 is similar to FIG. 2 with the control mechanism in its valve deactivated condition.
Figure 4:
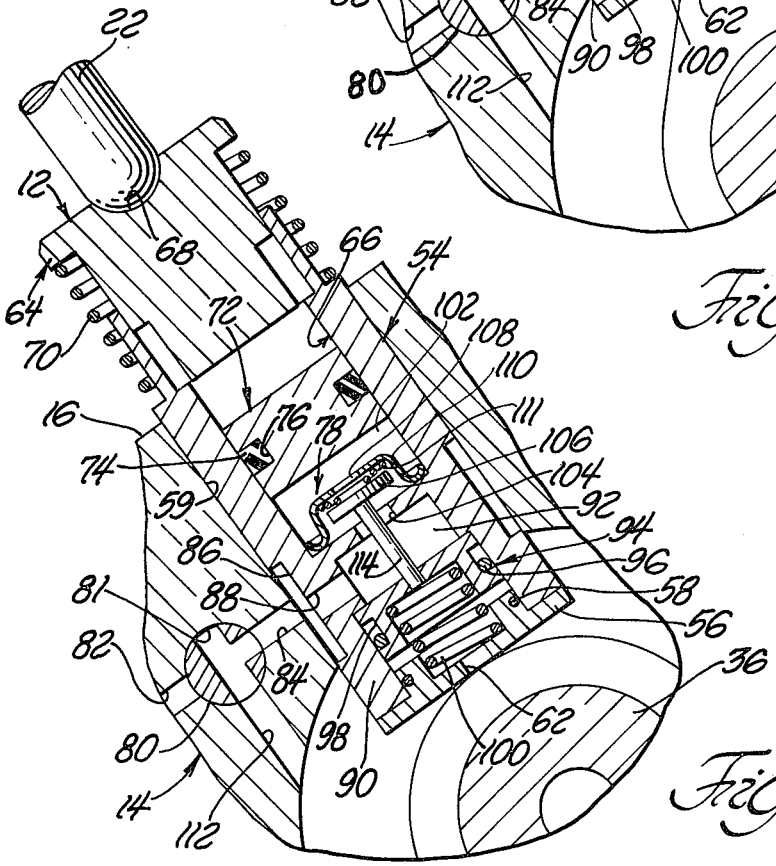
FIG. 4 is similar to FIGS. 2 and 3 showing the control mechanism in operation after entering its valve deactivated condition.

With reference to FIG. 3, when it is desired to place the valve control mechanism 10 in its valve deactivated condition, the control valve 80 is placed in a second rotational position by rotating the valve 80 ninety degrees from the position shown in FIG. 2 in a clockwise direction to thereby stop the supply of oil and oil pressure through the inlet passage 82 and also to vent the oil contained within the tappet 12 through an exhaust passage 112 formed in the cylinder block 16 and into the area about the camshaft 36. As the oil pressure in the lower chamber half 92 reaches atmospheric pressure the slide 94 moves axially away from the end plate 56 in response to the pressure exerted by the spring 100 until a projecting pin 114 which is fixedly mounted to the slide 94 and extends in an axial direction away from the end plate 56, unseats the check valve 106. As shown in FIG. 3 the valve spring pressure is not applied through the pushrod 22 to the tappet 12 due to the camming action of the cam 34 to allow the pin 114 to unseat the check valve 106.

Subsequent movement of the tappet 12 in response to the camming action of the cam 34 moves the second member 64 and the piston 72 together towards the first member 54, which movement will expel the oil from the upper chamber half 102, past the check valve 106 and out of the valve control mechanism 10 through the exhaust passage 112. Further camming action by the cam 34 allows the tappet 12 to remain in contact with the rocker arm 24 by extension and compression of the spring 70 which provides a lost motion connection and which has insufficient strength to open the valve 28. As shown in FIG. 3 relative movement also exists between the piston 72 and the second member 64.

In the change from standard to split engine operation, a solenoid (not shown) or other actuating mechanism, may be provided to rotate the control valve 80 one-quarter of a revolution from the position shown in FIG. 2 to the position shown in FIG. 3 and back again.

While a preferred embodiment of the valve control mechanism has been shown and described herein in detail those skilled in this art will recognize various alternative designs and embodiments for practicing the present invention as defined by the following claims.

What is claimed is:

1. An internal combustion engine cylinder valve control mechanism for use in the valve train of the engine to selectively deactivate a cylinder valve, said mechanism comprising: first and second cylindrical members reciprocable in an axial relationship with respect to each other to define a cavity therebetween of a volume that varies upon relative axial movement between the members said first cylindrical member being adapted to slidingly engage a camshaft of the engine, said second cylindrical member being adapted for connection to a pushrod of the valve train to move therewith; a piston located within said cavity and sealingly slidable in axial relationship with the first cylindrical member to define a chamber therebetween that varies upon relative axial sliding between the first cylindrical member and the piston; an inlet passage for feeding pressurized fluid to the chamber to move the piston away from the first cylindrical member to prevent the second cylindrical member from reciprocating with respect to the first cylindrical member; an exhaust passage exhausting the pressurized fluid from the chamber so that the piston is movable towards the first cylindrical member to allow the second cylindrical member to reciprocate with respect to the first cylindrical member to deactivate the valve operation; biasing means operatively associated with the first and second cylindrical members for biasing the first and second cylindrical members apart wherein said first cylindrical member maintains sliding engagement with the camshaft so that said mechanism slides on the camshaft during the reciprocation due to the biasing action of the biasing means; a support having an aperture extending completely therethrough for slidably supporting said first cylindrical member for axial reciprocation therein; a valve operatively disposed in said support for alternately opening and closing said inlet and outlet passages, for selectively placing said inlet and outlet passages in fluid communication with said chamber; wherein the first cylindrical member has a control port for feeding pressurized fluid to the chamber from the inlet passage; a check valve that prevents the pressurized fluid from flowing from the chamber back through the control port and through the inlet passage; a third cylindrical member sealingly slidable in axial relationship with the first cylindrical member within the cavity and having a projecting member extending in an axial direction towards said check valve to open the check valve to allow the pressurized fluid to be exhausted from the chamber; and resilient means for biasing said third cylindrical member toward said check valve, to thereby open said check valve in the absence of pressurized fluid from the inlet passage.

* * * * *